US007655875B1

(12) United States Patent
Dornfeld

(10) Patent No.: US 7,655,875 B1
(45) Date of Patent: Feb. 2, 2010

(54) LEVER SWITCH

(75) Inventor: David P. Dornfeld, Killingworth, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 232 days.

(21) Appl. No.: 11/894,409

(22) Filed: Aug. 21, 2007

(51) Int. Cl.
*H01H 9/00* (2006.01)

(52) U.S. Cl. ..... 200/292; 200/335

(58) Field of Classification Search ..... 200/292
See application file for complete search history.

(56) References Cited

U.S. PATENT DOCUMENTS 3,892,932 A * 7/1975 Erdelitsch et al. ..... 200/61.27
4,132,128 A * 1/1979 Roggenkamp ..... 74/527
4,429,196 A * 1/1984 Beig et al. ..... 200/61.54
5,570,777 A 11/1996 Skarivoda
5,668,359 A 9/1997 Alvord et al.
7,166,811 B2 * 1/2007 Kontani et al. ..... 200/61.54

* cited by examiner

*Primary Examiner*—Michael A Friedhofer
*Assistant Examiner*—Lheiren Mae A Anglo
(74) *Attorney, Agent, or Firm*—Alix, Yale & Ristas, LLP

(57) ABSTRACT

A lever operated switch employs an actuating surface and a plurality of tactile switches to generate electrical states corresponding to distinct angular orientations of the lever. The lever extends from a cam having an actuating surface configured to change the state of one switch when the lever is moved between adjacent positions. The cam is reversible, permitting the switch to be mounted on opposite sides of a support with the same lever movement and switch actuation.

18 Claims, 6 Drawing Sheets

LEVER SWITCH

BACKGROUND

The application relates to a lever actuated switch assembly for generating multiple output states and, more particularly, to a lever actuated switch assembly in which a PC board forms part of the switch structure.

Lever switches that translate discrete positions of a lever into varying electrical contact states are known. Such switches can include complicated mechanical assemblies and may be expensive and unreliable. One use environment for such switches is on a control head in an emergency vehicle, where the switch actuates emergency warning devices such as signaling lights and sirens. Such switches are subject to long-term rough use under a wide range of environmental conditions. In this use environment, the several positions of the switch lever corresponding to different electrical states must be positively indicated to the user and stable when subjected to vibration and shock.

An objective of the present application is to disclose an improved lever switch having increased durability and lower cost of manufacture.

SUMMARY

The present disclosure relates to a lever switch that uses a rigid, planar support such as a PC board to define and maintain physical relationships between the actuating surface of a lever operated cam and a plurality of switches. The disclosed lever switch employs standard hardware and switch components in combination with two custom engineered components to provide a switch of reduced cost and improved functionality. In an exemplary embodiment, a lever-operated actuator assembly translates four lever positions into four output electrical states. The disclosed design permits selection of switch components suitable for producing the outputs and/or delivering power to loads for a particular application, rather than being limited to the electrical configuration of a self-contained assembly.

DETAILED DESCRIPTION

Figure 2:
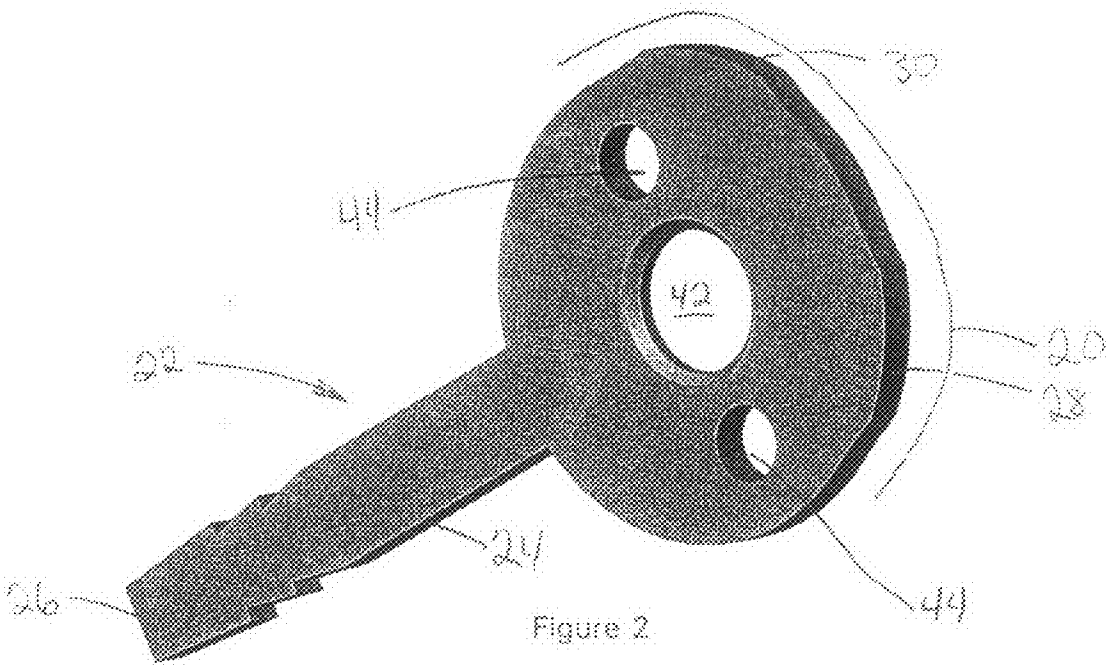
FIG. 2 is a perspective view of an embodiment of a lever according to aspects of the present invention.

An embodiment of the disclosed lever switch will be described with respect to FIGS. 1-10, wherein like numerals represent like elements. The lever switch 10 includes an actuator assembly 12 and two switches 14, 16 mounted to a PC board 18. The actuator assembly 12 supports the actuating surface 20 of a lever 22 in a position to change the state of switches 14, 16, as shown in FIGS. 1 and 5-9. The actuator assembly 12 defines four distinct lever positions, which the switches 14, 16 and the actuating surface 20 of the lever 22 translate into four electrical states for use as inputs to a control circuit.

Figure 3:
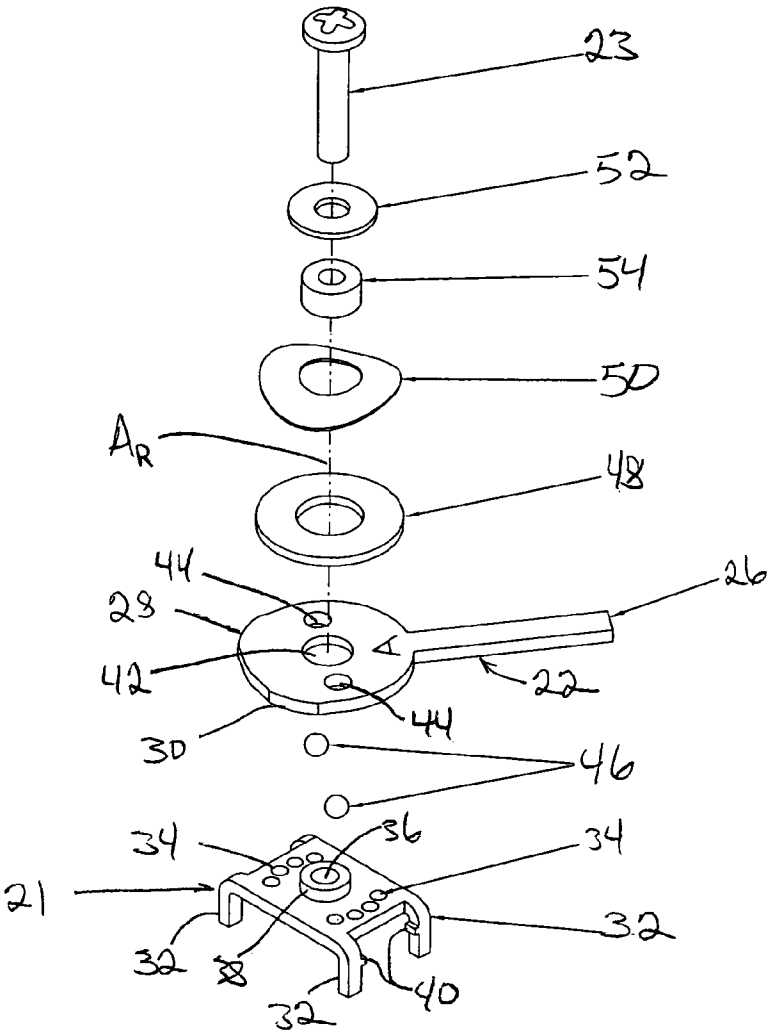
FIG. 3 is an exploded perspective view of the actuator assembly of the switch of FIG. 1.
Figure 10:
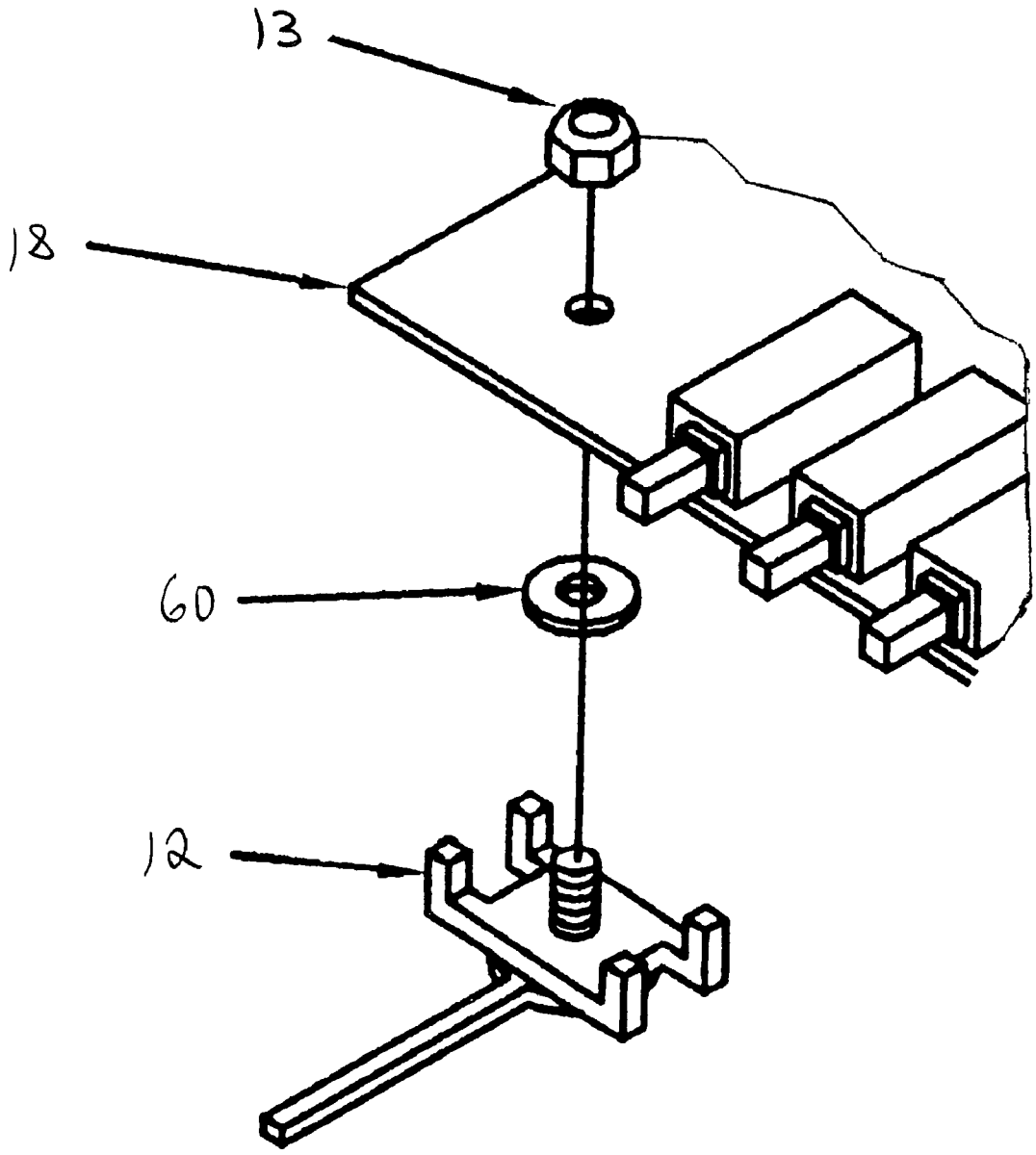
FIG. 10 is a perspective view of a representative installation of the disclosed embodiment of an actuator assembly mounted with respect to a PC board.

The components of the actuator assembly 12 are shown in FIG. 3. In the illustrated embodiment, 8 of the 11 components of the actuator assembly 12 are standard hardware items. The engineered components of the actuator assembly are the base 21 and the lever 22. A fastener 23 maintains the components in their functional relationships and provides a means for attaching the actuator assembly 12 to the PC board via a nut 13 as shown in FIGS. 1 and 10.

Figure 1:
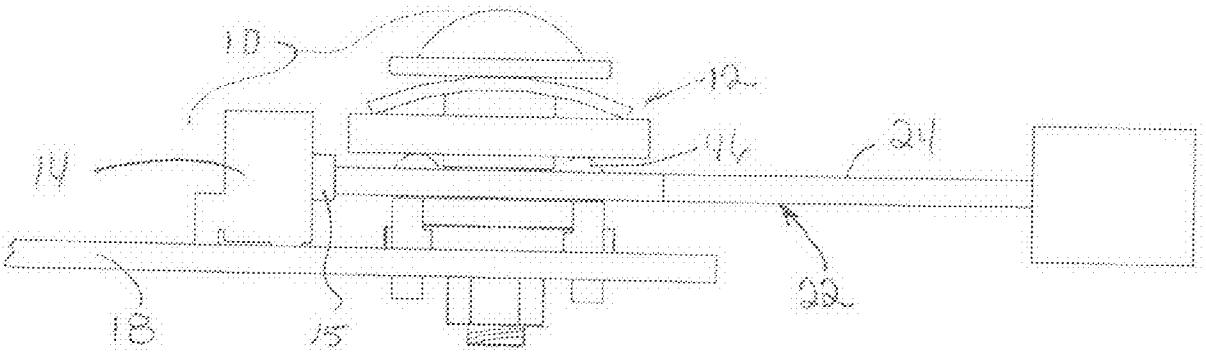
FIG. 1 is a side view of an embodiment of the disclosed lever switch mounted to a PC board.

The lever 22 includes a radially projecting arm 24 having a distal end 26 at which an operator control knob may be attached, as shown in FIG. 1. The actuating surface 20 of the lever 22 is opposite the arm 24 and includes two radially projecting lobes 28, 30. As best shown in FIGS. 6-9, the position of the lobes 28, 30 with respect to the arm 24 is not symmetrical. This arrangement places the lobes 28, 30 in a position to provide the desired actuation of switches 14, 16 in the four lever positions, as will be described in greater detail below.

The base 21 includes four legs 32 to support the actuator assembly at a height where the actuating surface 20 of the lever 22 is positioned to cooperate with the selected switches 14, 16. The upper surface of the base defines two arcuate arrangements of depressions, or holes 34. The center of the base defines an opening 36 for receiving the fastener 23 and includes a collar or shaft 38 about which the lever 22 will rotate. The center of the fastener opening 36 therefore defines an axis of rotation $A_R$ for the lever 22. The arcuate arrangements of holes 34 are concentric with the fastener opening 36. A lateral projection 40 on each leg 32 of the base 21 supports the base at a predefined height above the PC board when the legs 32 are received in holes in the PC board as shown in FIG. 1.

The lever 22 has a central opening 42 for receiving the shaft 38 projecting from the base 21. The lever 22 also includes two diametrically opposed openings 44 for retaining ball bearings 46. The lever arm 24 will typically project through a slot shaped opening in a housing or face plate (not shown) of a control head mounted in the passenger cabin of an emergency vehicle.

As shown in FIG. 3, the lever 22 fits over the shaft 38 of the base 21 and ball bearings 46 are inserted in the openings 44. A first flat washer 48 is placed over the ball bearings 46 to retain them in the openings 44. A spring washer 50 is compressed between the first flat washer 48 and a second flat washer 52 by the fastener 23 to spring bias the ball bearings, but not the lever, toward the base 21. A bushing 54 passes through the first flat washer 48 and spring washer 50 to engage the top of the shaft 38 and retain the lever 22 in its position about the shaft. The shaft 38, lever 22 washers 48, 50, 52 and bushing 54 are selected so that when the fastener 23 is tightened to secure the assembly to a PC board as shown in FIG. 1, pressure from the spring washer 50 is exerted against the ball bearings 46 via the first flat washer 48, while the lever 22 is retained about the shaft but permitted free rotational movement. In the disclosed embodiment, the bushing 54 has an outside diameter greater than the diameter of the shaft 38, providing a shoulder that holds the lever 22 in position.

When the ball bearings 46 are aligned with pairs of holes 34 on the base 21, the spring bias on the ball bearings 46 seats them in the holes 34 to positively define a distinct position of the lever 22 with respect to the base 21. Distinct switch positions are important in the emergency vehicle environment, where operators may be wearing gloves and are likely to be distracted when operating emergency warning equipment. To move the lever 22 from a position where the ball bearings 46 are seated in a pair of holes 34, sufficient pressure must be applied to the arm 24 to overcome the spring bias of the spring washer 50. It should be noted that the fastener 23, flat washers 48, 52, spring washer 50, bushing 54, and ball bearings 46 are all standard hardware items.

The illustrated PC board-mounted switches 14, 16 are also standard off the shelf items. One example of an appropriate switch is the TL 1105 single pole, single throw switch, available from E-Switch. These switches have an actuator 15 projecting from the switch body in a direction substantially parallel to the PC board 18. The switch actuator 15 of the selected switches must be moved approximately ten thousandths of an inch (0.010") to change the state of the switch contacts. Each lobe 28, 30 of the actuating surface 20 of the lever 22 projects radially approximately twenty thousandths of an inch (0.020") to reliably actuate the switches 14, 16. The electrical contacts of the selected switches 14, 16 are normally open, with the switch actuators biased toward the extended position shown in FIG. 5. Those skilled in the art will recognize that opposite electrical states for a given lever position could be generated by switches having a normally closed configuration. It will also be apparent that selecting normally closed switches and reversing the profile of the actuating surface would duplicate the electrical states generated by the disclosed components.

Figure 5:
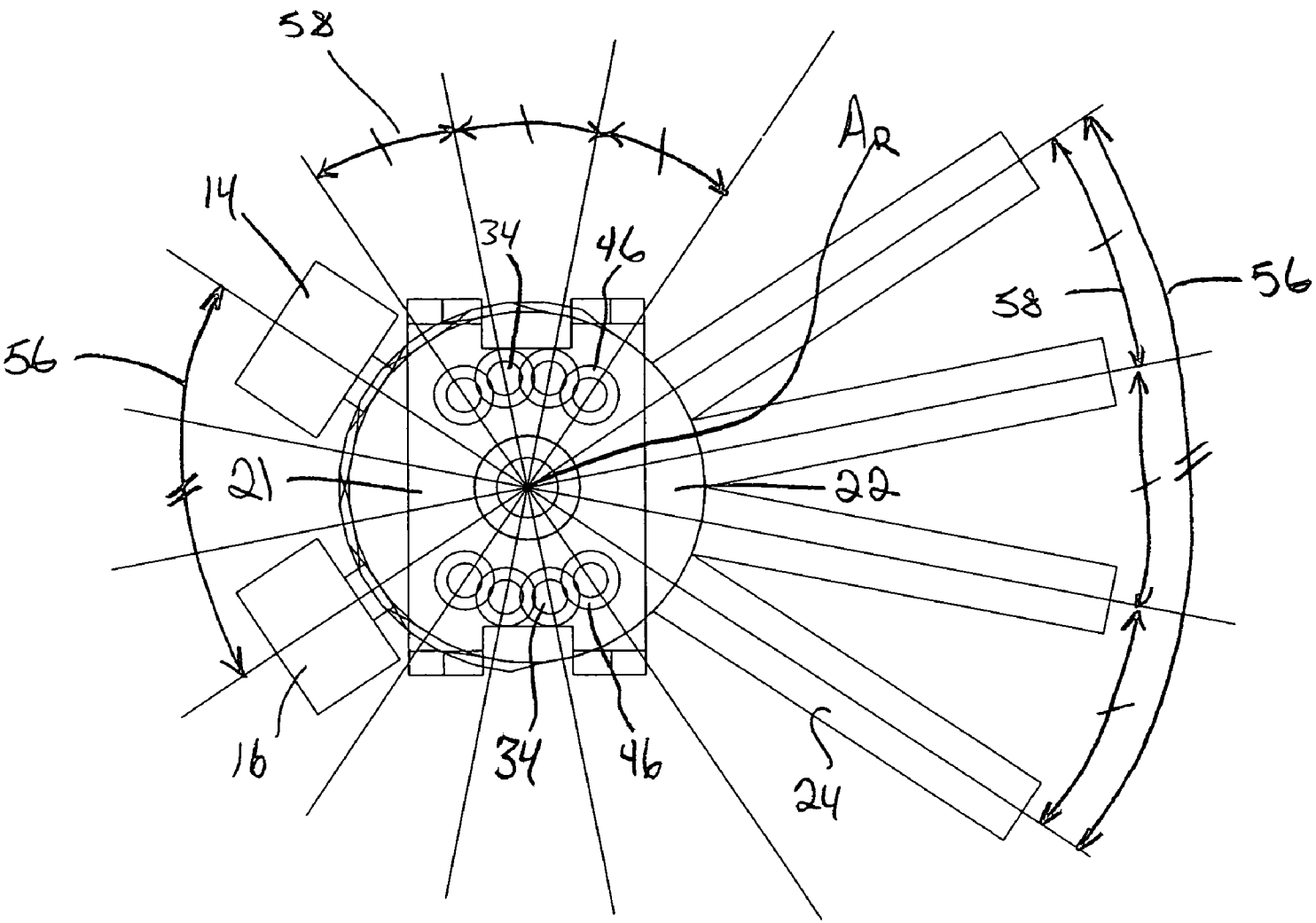
FIG. 5 is a geometric view of the base, lever and switch components of FIG. 2, showing the angular relationships among the components and lever positions.

FIG. 5 illustrates the angular relationships among the components of the disclosed lever switch. The disclosed lever assembly is designed to provide four distinct lever positions distributed over an arc 56 of approximately 67.5°. The ball bearing detents 34 are arranged to define four lever positions separated by an arc 58 of approximately 22.5° when the spring-biased ball bearings 46 seat in diametrically opposed pairs of detents 34. The switches 14, 16 are separated from each other by an arc 56 of about 67.5° and arranged on the PC board so that their actuators 15 move in a direction aligned with the axis of rotation $A_R$ of the lever 22. The actuating surface 22 of the lever includes two radially projecting lobes 28, 30. Each lobe in the disclosed embodiment has an arcuate length sufficient to actuate a switch in two adjacent lever positions.

Figure 4:
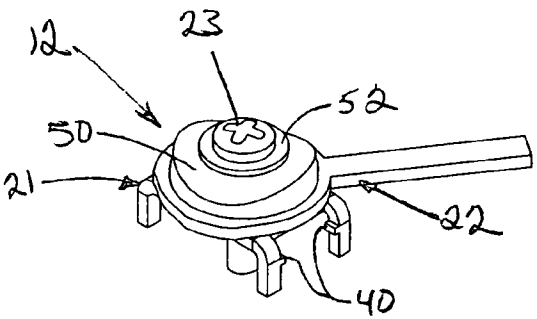
FIG. 4 is a perspective assembled view of the actuator assembly of FIG. 3.

FIGS. 6 through 9 show the relative positions of the base 21, lever 22 and actuators 15 of switches 14, 16 corresponding to each of the four lever positions. FIGS. 6-9 illustrate the base 21, lever 22 and switches 14, 16 from beneath the base as it is shown in FIGS. 1, 3 and 4 (or looking down from above in the orientation shown in FIG. 10). The disclosed lever switch 10 may be mounted to either the top or bottom surface of a PC board 18 and may be configured to operate from left to right (counter clockwise), as shown in FIGS. 6-9, or right to left (clockwise), by reversing (flipping over) the installed position of the lever 22 with respect to the base 21. The positions of the ball bearings 46 in FIGS. 6-9 are shown by the large concentric circle over opposed detents 34.

Figure 6:
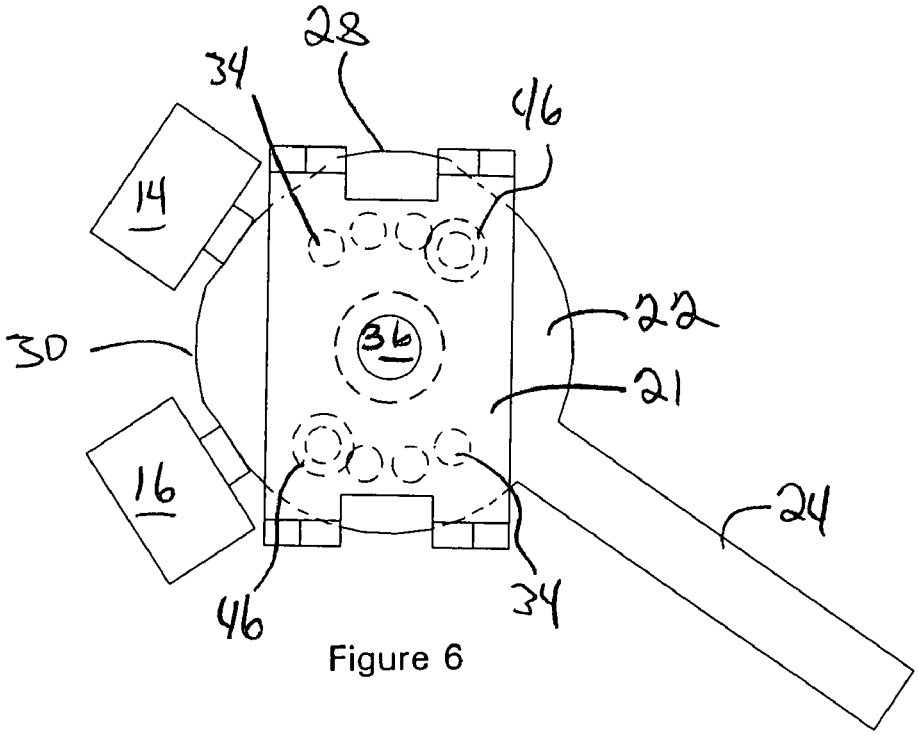
FIG. 6 is a bottom view of the base, lever and switch components of the switch of FIG. 1, showing the respective relationships of the components in a first lever position.

FIG. 6 illustrates the lever 22 in a first position corresponding to an off state, where neither lobe 28, 30 is engaged with the actuator 15 of a switch 14, 16. Given that the selected switches are normally open, the output state associated with the lever position illustrated in FIG. 6 is 0-0, both switches being open.

Figure 7:
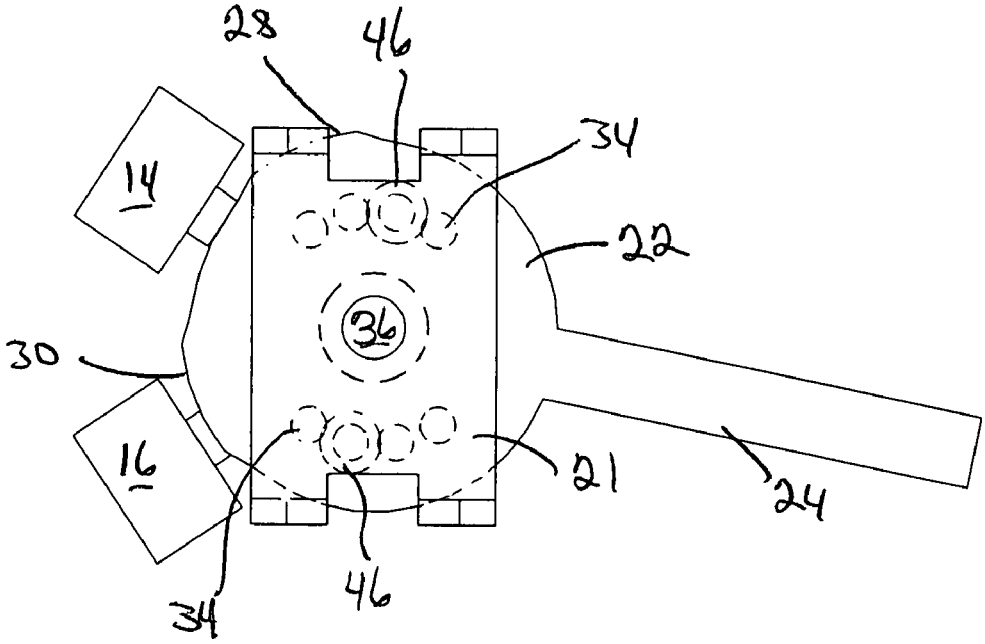
FIG. 7 is a bottom view of the base, lever and switch components of the switch of FIG. 1, showing the relative positions of the components in a second lever position.

FIG. 7 shows the lever in a second position, with the actuator 15 of switch 16 engaged by lobe 30. This lever position corresponds to a 1-0 output state, with one switch closed and the other switch remaining open.

Figure 8:
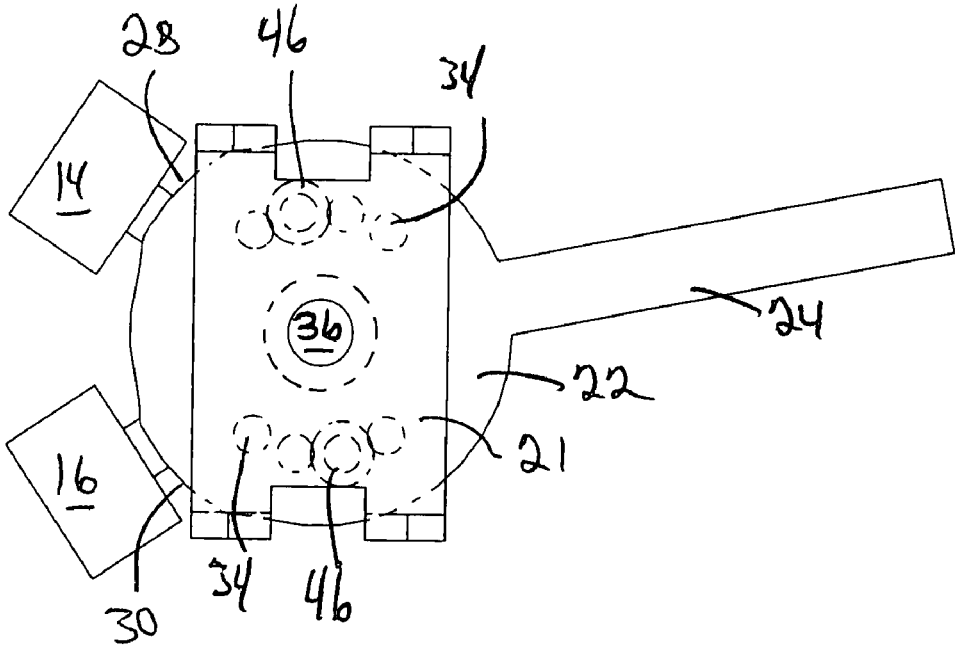
FIG. 8 is a bottom view of the base, lever and switch components of the switch of FIG. 1, showing the respective positions of the components in a third lever position.

FIG. 8 shows the lever in a third position, with the actuator 15 of switch 16 still engaged with lobe 30 and the actuator 15 of switch 14 engaged by lobe 28. This lever position corresponds to a 1-1 output state, both switches being closed.

Figure 9:
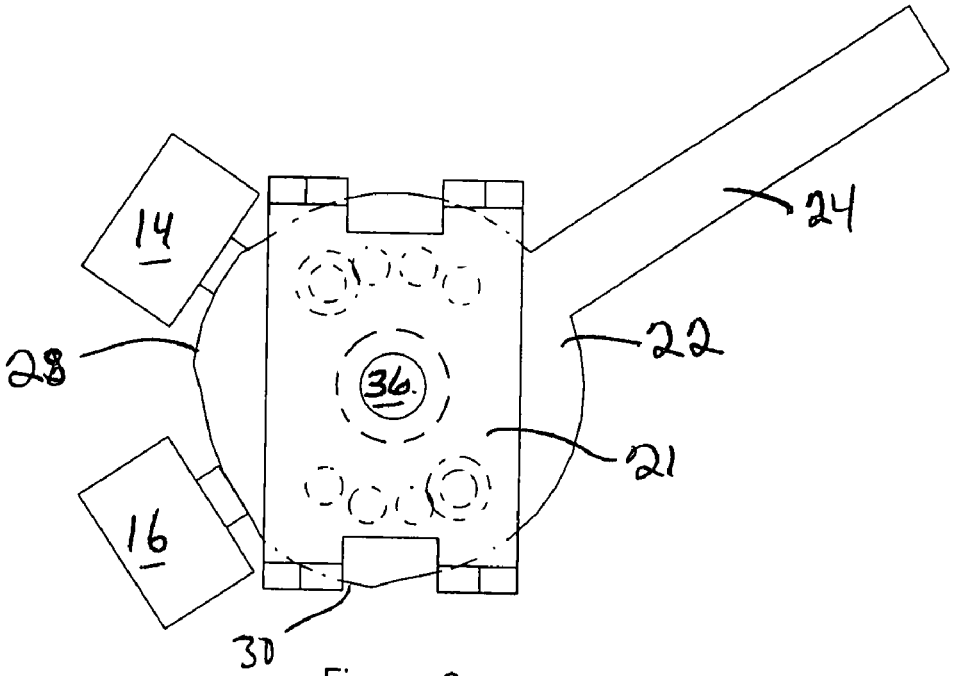
FIG. 9 is a bottom view of the base, lever and switch components of the switch of FIG. 1, showing the relative positions of the components in a fourth lever position.

FIG. 9 shows the lever in a fourth position, with the actuator 15 of switch 16 released by lobe 30 and the actuator 15 of switch 14 still engaged by lobe 28. This lever position corresponds with a 0-1 output state, one switch being open and the other switch being closed.

Thus the disclosed lever switch provides outputs corresponding to four electrical states 0-0, 1-0, 1-1 and 0-1. These electrical states may be employed as inputs to an electronic circuit or micro-controller to produce corresponding outputs.

FIGS. 1 and 10 illustrate the disclosed lever switch 10 mounted to a PC board 18. A flat washer 60 is placed beneath the base 21 to permit sufficient tightening of the fastener 23 without bending or damaging the PC board 18 or base 21. The disclosed switch assembly may be mounted to the top or bottom of a PC board. It will be understood that if all components are arranged in the mirror image positions on the opposite side of a PC board, lever action will be reversed. Flipping the lever 22 over with respect to the base 21 reverses the actuating direction.

The present invention has been described in the context of specific embodiments. Other alternatives, modifications and variations will become apparent to those skilled in the art having read the foregoing description. Accordingly, it is intended to embrace those alternatives, modifications and variations that fall within the broad scope of the appended claims.

The invention claimed is:

1. A switch assembly comprising:

a rigid substantially planar support;

a base mounted to said support, said base comprising a plurality of angularly spaced surface features and an opening defining an axis of rotation;

a plurality of switches mounted to said support, each said switch having a switch body in fixed position with respect to said support, an actuator moveable with respect to said switch body and biased toward an extended position with respect to said switch body, and an electrical contact operably connected to said actuator, wherein movement of said actuator from said extended position to a depressed position with respect to said switch body changes the state of said at least one electrical contact;

a lever mounted to said base for movement about said axis of rotation, said lever comprising a radially extending arm, an actuating surface and locating features, said actuating surface comprising a plurality of radially projecting lobes, said surface features cooperating with said locating features to define a plurality of distinct lever positions with respect to said base, wherein movement of said arm between said distinct lever positions causes said lobes to depress or release the actuator of one of said switches, changing the state of said electrical contact of said switch and at least one of said lobes has an arcuate extent which maintains one of said switch actuators in a depressed position in two adjacent of said plurality of distinct positions.

2. The switch assembly of claim 1, wherein said support is a portion of a PC board.

3. The switch assembly of claim 1, said base comprising a shaft surrounding said opening and said lever being configured to fit over and rotate about said shaft.

4. The switch assembly of claim 1, wherein said plurality of angularly spaced surface features and locating features interact to define four distinct lever positions, each of said distinct lever positions being angularly equidistant from an adjacent lever position.

5. The switch assembly of claim 4, wherein said plurality of switches comprises two switches and said plurality of lobes comprises two lobes, each said lobe having an arcuate extent sufficient to maintain one of said switch actuators in a depressed position in two adjacent of said plurality of distinct positions.

6. The switch assembly of claim 1, wherein said plurality of switches comprises two switches and said plurality of lobes comprises two lobes, each said lobe having an arcuate extent which maintains one of said switch actuators in a depressed position in two adjacent of said plurality of distinct positions.

7. The switch assembly of claim 1, wherein said surface features comprise one of a protrusion or a detent and said locating features comprise the other of a protrusion or a detent, said protrusion and detent cooperating to define a distinct lever position.

8. The switch assembly of claim 1, wherein said surface feature comprises an arcuate arrangement of detents and said locating feature comprises a hemispherical protrusion complementary to said detent.

9. The switch assembly of claim 8, wherein said locating feature comprises a ball bearing carried by said lever.

10. A switch assembly comprising:

a rigid planar support;

two switches mounted to said support on a first side thereof, each switch comprising an electrical contact and an actuator arranged to change the state of said electrical contact when moved from an extended position to a retracted position, said actuator biased toward said extended position;

a base mounted to said support on said first side thereof, said base comprising surface features and an opening defining an axis of rotation;

a cam secured to said base for movement about said axis of rotation, said cam having a first side perpendicular to said axis of rotation and a peripheral edge, said first side facing said base and including locating features arranged to cooperate with said surface features to define four distinct cam positions with respect to said base and support, said cam comprising a lever radially extending from said peripheral edge and an actuating surface on said peripheral edge, said actuating surface including a pair of radially projecting actuating lobes, each said lobe configured to move the actuator of one said switch from one of an extended position or a retracted position to the other of an extended position or a retracted position, each said lobe having an arcuate extent which maintains the one said switch in the said extended or retracted position in two adjacent cam positions, wherein said lobes are arranged to change the state of the electrical contact of one said switch with movement of said cam from one said distinct position to an adjacent of said distinct positions.

11. The switch assembly of claim 10, wherein said locating features are substantially spherical balls retained in apertures in said cam and moveable with respect to said cam and base along a path generally parallel to said axis of rotation.

12. The switch assembly of claim 11, comprising a spring for biasing said balls against said surface features, whereby said cam is maintained in each said distinct position until a force is applied to said lever to overcome said bias and rotated said cam with respect to said base.

13. The switch assembly of claim 10, wherein four distinct positions correspond to four equiangularly spaced lever positions with respect to said base, the first and fourth of said lever positions corresponding to lever positions traversing an arc of less than 90°.

14. The switch assembly of claim 13, wherein said cam is a substantially flat component having a second side substantially identical to said first side and mounting said cam to said base with said second side facing said base reverses the lever position with respect to said base corresponding to said first through fourth lever positions.

15. A multi-position actuator assembly comprising:

a base having an upper surface including diametrically opposed arcuate arrays of surface features and an opening defining an axis of rotation, the surface features in each said arcuate array being angularly equidistant from each other;

a cam mounted to said base for rotation about said axis, said cam having first and second surfaces generally orthogonal to said axis of rotation and mounted with one of said first or second surfaces facing said base, said cam comprising:

diametrically opposed apertures through said first and second surfaces and concentric with said surface features;

a radially extending lever; and a radially directed actuating surface;

locating members arranged in said apertures and movable with respect to said cam in a direction generally parallel to said axis of rotation, a disc arranged to retain said locating members in said apertures; and a biasing member biasing said disc and locating members toward said base, wherein said locating members cooperate with said surface features to define a plurality of discrete cam positions with respect to said base, said plurality of cam positions being equiangularly distributed over an arc of less than 180°, mounting said cam with said first surface facing said base providing a first set of actuating surface and lever positions with respect to said base and mounting said cam with said second surface facing said base provides a second set of actuating surface and lever positions with respect to said base that is the reverse of said first set.

16. The actuator assembly of claim 15, wherein said surface features are substantially circular detents and said locating members are substantially spherical balls.

17. The actuator assembly of claim 15, comprising a collar surrounding said axis of rotation, said cam includes a central opening configured to receive said collar and said cam, disc and biasing member are secured to each other by a fastener provided with a shoulder having a diameter larger than said central opening, whereby said cam is retained against said base by said shoulder.

18. The actuator assembly of claim 17, wherein said shoulder is provided by a bushing surrounding said fastener and passing through said disc and said biasing member, said disc and locating members permitted axial movement independent of said cam.

* * * * *